US006965218B2

(12) United States Patent
Scoones et al.

(10) Patent No.: US 6,965,218 B2
(45) Date of Patent: Nov. 15, 2005

(54) VOLTAGE REGULATOR

(75) Inventors: Kevin Scoones, Munich (DE); Martin Rommel, Freising (DE)

(73) Assignee: Texas Instruments Incorporated, Dallas, TX (US)

( * ) Notice: Subject to any disclaimer, the term of this patent is extended or adjusted under 35 U.S.C. 154(b) by 81 days.

(21) Appl. No.: 10/679,789

(22) Filed: Oct. 6, 2003

(65) Prior Publication Data

US 2004/0104711 A1 Jun. 3, 2004

(30) Foreign Application Priority Data

Oct. 22, 2002 (DE) ..... 102 49 162

(51) Int. Cl.[7] ..... G05F 1/40
(52) U.S. Cl. ..... 323/280; 323/274
(58) Field of Search ..... 323/270, 271, 323/273, 274, 275, 277, 280, 281

(56) References Cited

U.S. PATENT DOCUMENTS 5,672,959 A * 9/1997 Der ..... 323/273
6,600,299 B2 * 7/2003 Xi ..... 323/280
6,703,815 B2 * 3/2004 Biagi ..... 323/280

* cited by examiner

*Primary Examiner*—Jessica Han
(74) *Attorney, Agent, or Firm*—W. Daniel Swayze, Jr.; W. James Brady; Frederick J. Telecky, Jr.

(57) ABSTRACT

A voltage regulator includes a two-stage feedback circuit for driving a controller formed by a transistor 10. The feedback circuit includes an error amplifier 30 and an output amplifier 20, a simple compensating circuit in the form of a resistor $R_{sz}$ inserted between the inverting input 22 and the non-inverting input 24 of the output amplifier 20 resulting in a high phase reserve of the feedback circuit. The resistor $R_{SZ}$ limits the gain of the error amplifier 30 for small load currents by reducing its effective output impedance. This compensating circuit results in the two-stage feedback circuit being highly stable even when very low load currents are involved. This now makes it possible to achieve a very simple linear voltage regulator architecture totally integrated on a single chip. It is especially in battery-powered handhelds such as e.g. mobile phones or electronic organizers that this is important since these devices are often on standby with a low current consumption and activated for use only occasionally.

7 Claims, 3 Drawing Sheets

VOLTAGE REGULATOR

RELATED APPLICATION

This application claims priority under 35 U.S.C. §119 based on Germany Application No. 102 46 162.3 filed on Oct. 22, 2002.

FIELD OF THE INVENTION

The invention relates to a voltage regulator which may be integrated in a semiconductor circuit.

BACKGROUND OF THE INVENTION

Many battery-powered handhelds such as, for example, mobile phones or electronic notebooks contain complex integrated semiconductor circuits powered by one or more supply voltages. These supply voltages are often generated by voltage regulators, integrated in the semiconductor circuits, from a battery voltage. For this purpose in these devices so-called low dropout voltage regulators are often used which are capable of furnishing a stable regulated voltage even when the difference between the battery voltage and the desired supply voltage is very small. This is why the battery voltage must be only insignificantly higher than the desired output voltage and as a rule the dissipation loss of the voltage regulator is very low. In addition, the voltage regulator is capable of stabilizing the supply voltage even when the battery voltage has been greatly reduced due to discharge.

Voltage regulators may be configured with a simple single-stage feedback loop. Shown in FIG. 1 is a prior art variable voltage regulator as described, for example in the German Semiconductor Circuit Textbook by Tietze and Schenk, published by Springer-Verlag, $12_{th}$ edition, page 929. The controller in this voltage regulator is formed by a power transistor disposed between the input voltage terminal of the voltage regulator and the supply voltage terminal of a load symbolized in FIG. 1 by the current sink $I_{out}$ and which is controlled by a feedback signal of an amplifier termed error amplifier in FIG. 1 whose input receives a signal as a function of the supply voltage of the load and which outputs the feedback signal as a function of the difference between the supply voltage and a nominal value. For further stabilization of the supply voltage an output capacitor $C_{out}$ is usually inserted in parallel with load. The accuracy of the voltage regulator is dictated by the loop gain of the error amplifier which needs to be selected sufficiently high for correspondingly high requirements.

However, this circuit has some drawbacks. For one thing, the feedback circuit becomes unstable at a very low load current $I_{out}$ in tending to oscillate. The output impedance of the power transistor forms together with the output capacitor $C_{out}$ a low-pass which in circuit terminology is usually termed a pole position as derived from a mathematical description of the transient response widely used in circuitry by means of the Laplace transformation. In this arrangement the transient function of a low-pass is described by a function comprising a zero position in a polynomial denominator.

A second pole position of the voltage regulator as shown in FIG. 1 is formed by a low-pass consisting of the gate capacitance of the power transistor and the output impedance of the error amplifier. The second pole position normally has a lower frequency than the first pole position. Since, however, the output impedance of the power transistor diminishes with a reduction in the load current, the first pole position tends to drift to an increasingly lower frequency the lower the load current and can thus attain the value of the frequency of the second pole position. This results in the phase of the feedback signal being shifted through 180° and due to this positive feedback the voltage regulator becomes unstable.

Known further in feedback control systems (e.g. in the German textbook thereon by O. Föllinger, published by Hüthig Buch Verlag, $7_{th}$ edition, page 270) are cascaded feedback loops each of which can be optimized to thus feature improved performance as compared to single-stage feedback loops. Applying this to the present case of the feedback circuit for voltage regulators, this could result in a circuit, for instance, as shown in FIG. 2. With the two-stage feedback circuit as shown in FIG. 2 the drawbacks of the single-stage feedback circuit as described above can be eliminated to a certain extent. This time, the controller is formed by a power transistor whose main current path—which with field-effect transistors is formed by the drain/source channel and in bipolar transistors by the collector/emitter circuit—is disposed between the input voltage terminal $V_{in}$ and the supply voltage terminal $V_{out}$ which supplies the load. The outer loop is formed by an error amplifier, the one input of which receives a signal as a function of the supply voltage of the load and whose other input receives a reference voltage and which outputs the feedback signal as a function of the device of the supply voltage from a nominal value. With this feedback signal the non-inverting input of an output amplifier is controlled. The inverting input of the output amplifier is connected to a signal as a function of the supply voltage of the load. The output amplifier thus forms an inner feedback loop capable of working with a lower loop gain than the feedback loop in the single-stage configuration as described above, since the accuracy of the voltage regulator is dictated by the loop gain of the error amplifier.

The bandwidth of the outer loop is defined by a compensating capacitor $C_C$ connected to the output of the error amplifier. The compensating capacitor $C_C$ forms together with the output impedance of the error amplifier the pole position of the outer feedback loop. As described above, at very low load currents the other pole position of the output amplifier is shifted in the direction of lower frequencies. If the pole positions of the inner and outer loop have the same frequency the feedback circuit becomes unstable. Although this can be counteracted by suitably selecting the capacitor at the output of the error amplifier, this involves very high capacitance values taking up a lot of space on the chip; in other words, there possibly not being enough room to integrate the capacitor in the semiconductor circuit and it thus needs to be applied externally to the chip. This complicates such a feedback circuit and makes it expensive.

Another drawback of this circuit becomes evident when the load element has a very high current requirement, for instance due to the output being short-circuited to ground. In most voltage regulators this is counteracted by an additional circuit for limiting the output current. As soon as a critical maximum permissible current is attained the power transistor is turned off. In the turned off condition the output of the voltage regulator is grounded and the output of the error amplifier increases up to a maximum permissible potential corresponding to its positive operating voltage, for example. Once the short-circuit is eliminated, the voltage at the output of the voltage regulator spikes since the capacitor at the output of the error amplifier first needs to be discharged to allow the input voltage of the output amplifier to fall. This voltage spike may be damaging to the load being supplied.

SUMMARY OF THE INVENTION

It is thus the objective of the invention to provide a voltage regulator which eliminates the drawbacks of existing voltage regulators as described above.

This objective is achieved for the voltage regulator in accordance with the invention as cited above in that the voltage regulator now includes a transistor whose main current path circuited between the input voltage terminal of the voltage regulator and the output of the voltage regulator comprises an amplifier whose output is connected to the control terminal of the transistor and to the one input of which a voltage as a function of the output voltage of the voltage regulator is applied, and a transconductance amplifier whose output is connected to the other input of the amplifier, a first resistor and a capacitor wherein the one input of the transconductance amplifier is connected to a further voltage as a function of the output voltage of the voltage regulator whilst the other input of the transconductance amplifier is connected to a reference voltage dictating the output voltage of the voltage regulator and a further resistor is circuited between the one input and the other input of the amplifier.

This assembly in accordance with the invention now provides a voltage regulator having the advantage of a resistor being formed by a simple compensation circuit which increases the phase reserve at low load currents. This is especially important for battery-powered handhelds such as e.g. mobile phones or electronic organizers, since these devices are often on standby with a reduced current consumption and need to be activated only occasionally for use. The voltage regulator in accordance with the invention supplies the device on standby with a stable supply voltage without any additional circuiting needing to be implemented. In addition, due to the compensation circuit in the form of a resistor the response of the voltage regulator when overloaded by too high a current at the output of the voltage regulator is significantly improved by voltage spikes no longer appearing when the overload is removed in thus eliminating the need of complicated protective mechanisms at the output of the voltage regulator for remedying over voltages. In addition, in this compensation circuit a compensating capacitor is needed which features a smaller capacitance than that as shown in the circuit in FIG. 2. Accordingly, this component can now be integrated in a semiconductor circuit in eliminating the added costs for the complications of having to accommodate the capacitor externally.

DETAILED DESCRIPTION

Figure 3:
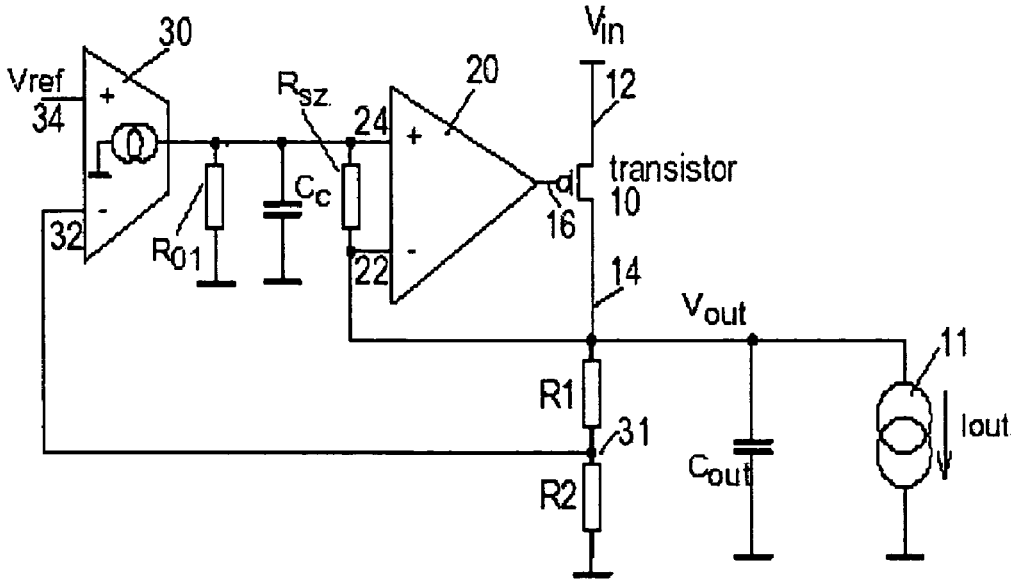
FIG. 3 is a block diagram of one embodiment of a voltage regulator in accordance with the invention.

Referring now to FIG. 3 there is illustrated an embodiment of a voltage regulator in accordance with the invention. The task of this voltage regulator is to convert an input voltage $V_{in}$ into a stable output voltage $V_{out}$ for the power supply of a load element 11. The load element 11 is symbolized in FIG. 3 by a current sink through which a load current $I_{out}$ flows. Circuited between the input voltage $V_{in}$ terminal of the voltage regulator and the output voltage $V_{out}$ terminal is a main current path of a transistor used as a controller. The load element 11 is circuited between the output voltage $V_{out}$ terminal and a fixed potential which may be ground, for example. Connected in parallel with the load element 11 is a capacitor $C_{out}$ having a relatively high capacitance for achieving additional stabilization of the output voltage $V_{out}$.

The voltage regulator in accordance with the invention will now be described for the case in which the input voltage $V_{in}$ assumes a positive value relative to the fixed potential of the load element 11 without this being understood as any limitation to this case, however. The person skilled in the art is aware of how the circuit can be made to function in the inverse situation of the potentials, for example, by replacing transistors of a first channel type by transistors of a second channel type.

Transistor 10 may be configured as a power transistor. When the input voltage $V_{in}$ is positive, for example, for this purpose a bipolar PNP transistor is suitable whose emitter is connected to the input voltage $V_{in}$ of the voltage regulator and whose collector is connected to the output voltage $V_{out}$ of the voltage regulator, or—as shown in FIG. 3—a PMOS field-effect transistor 10 whose source 12 is connected to the input voltage $V_{in}$ of the voltage regulator and whose drain is connected to the output voltage $V_{out}$ of the voltage regulator. If the voltage regulator in feedback operation is required to have a low drop in voltage between input voltage $V_{in}$ and output voltage $V_{out}$ of the voltage regulator the PMOS field-effect transistor 10 may be configured, for example, with a wide channel so that the resistance of the source/drain channel is very low; a voltage regulator in this mode usually being termed a low-dropout (LDO) regulator.

The gate 16 of the PMOS field-effect transistor 10 is connected to the output of an amplifier 20. The amplifier 20 may be, for example, an operational amplifier needing to comprise a low loop gain for correct functioning of the voltage regulator in accordance with the invention and thus can be configured very simple. Because of its function the amplifier 20 is termed output amplifier in the circuit in accordance with the invention. The inverting input 22 of the amplifier 20 is connected to the output voltage $V_{out}$ terminal. The amplifier 20 forms with this negative feedback a first inner feedback loop. Its non-inverting input 24 is connected to the output of an error amplifier 30.

The error amplifier 30 forms a second, outer feedback loop in which the negative feedback is a function of the output voltage $V_{out}$ of the voltage regulator. For this purpose, as evident from FIG. 3, the output voltage $V_{out}$ can be reduced by a fixed factor prior to negative feedback, for example by a voltage divider. It is for this purpose that a voltage divider as may consist of two resistors R1 and R2 is inserted between the output voltage $V_{out}$ terminal of the voltage regulator and a fixed reference potential such as ground. The center terminal 31 of the voltage divider is connected to the inverting input 32 of the error amplifier 30 whilst the non-inverting input 34 of the error amplifier 30 is connected to a fixed reference voltage $V_{ref}$ dictating the value of the output voltage $V_{out}$ of the voltage regulator.

The error amplifier 30 takes the form of a transconductance amplifier furnishing at its output as a function of the voltage difference at non-inverting input 34 and inverting input 32 a current which is proportional to the slope $G_M$ of the error amplifier 30. This current is converted into a voltage at the output of the transconductance amplifier by an output impedance which for example as shown in FIG. 3, may be a ohmic resistor resistor $R_{O1}$. The value of the resistor $R_{O1}$ thus dictates the gain of the error amplifier 30 and needs to be adapted to the slope $G_M$ of the error amplifier 30. The accuracy of the feedback stage depends on the gain of the error amplifier. Accordingly, if the value of the resistor $R_{O1}$ is too high, the feedback circuit action would be too sensitive, whereas if the value of the resistor $R_{O1}$ is too low, the feedback circuit action would be too limited. Resistor $R_{o1}$ is connected by one terminal to the output of the error amplifier 30 whilst its other terminal is connected to a fixed potential, for example ground. In addition, the output of the error amplifier 30 is connected to a compensating capacitor $C_C$ which together with the resistor $R_{O1}$ forms the dominating pole position of the outer loop. With the aid of the compensating capacitor $C_C$ the frequency response of the outer feedback loop is set so that its bandwidth for high load currents $I_{out}$ is smaller than the bandwidth of the inner feedback loop.

The inverting input 22 and non-inverting input 24 of the output amplifier 20 are connected to a resistor $R_{SZ}$ which serves to compensate the gain of the outer loop at low load currents $I_{out}$, as will now be explained.

As long as the voltage at the output of the output amplifier 20 follows that at the output of the error amplifier 30, resistor $R_{SZ}$ has no effect on the gain, because the inverting input 22 and non-inverting input 24 have the same potential and there is thus no drop in voltage across the resistor $R_{SZ}$. The resistor $R_{SZ}$ is only effective when the output of the output amplifier 20 is no longer able to follow the output signal of the error amplifier 30 because of a sudden change in the load current $I_{out}$. This relates mainly to changes in the load current $I_{out}$ occurring in a frequency range remote from the bandwidth of the output amplifier 20.

Due to the output impedance of the transistor 10 being a function of the current $I_{out}$ by the load element 11, the bandwidth of the output amplifier is reduced with a reduction in the load current $I_{out}$. For a more precise description of the function of the resistor $R_{SZ}$ three different cases can be distinguished by the bandwidth of the output amplifier 20 become larger, smaller or remaining roughly the same as that of the error amplifier 30 in a range of the Load current $I_{out}$ for feedback.

In the first case, the change in the load current occurs in a range in which the load current $I_{out}$ is so large that the bandwidth of the output amplifier 20 is wider than that of the error amplifier 30. The output amplifier 20 has the function of a voltage follower, the effect of the resistor $R_{SZ}$ on the load element not being noticeable, since the changes in the load current $I_{out}$ are remote from the bandwidth of the error amplifier 30.

Figure 1:
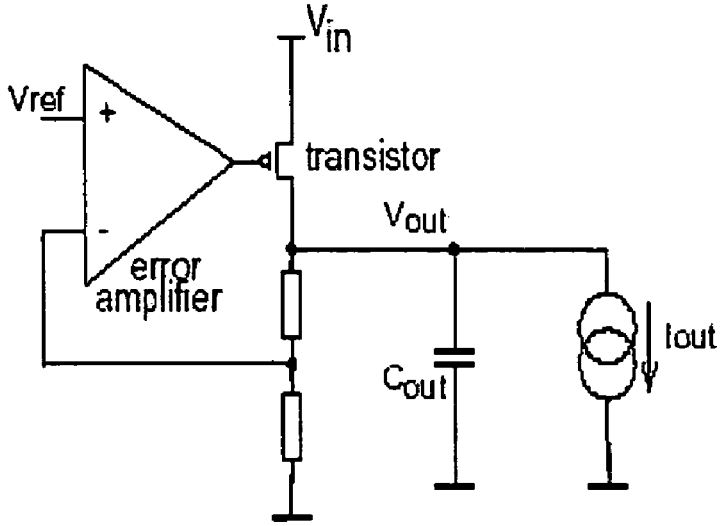
Fig. 1 (prior art)
FIG. 1 is a block diagram of a prior art voltage regulator.
Figure 2:
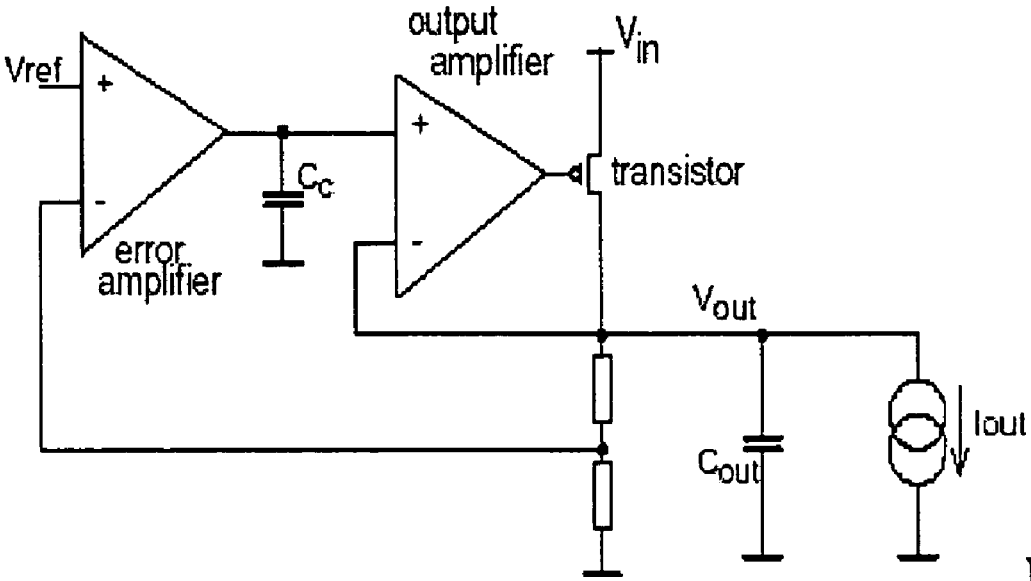
FIG. 2 is a block diagram of a voltage regulator of the present invention.

In the case of very small load currents, however, the bandwidth of the output amplifier 20 is reduced, as explained above. In this case in which, for example, the circuit as shown in FIG. 2 would be in an unstable condition, the resistor $R_{SZ}$ reduces the gain of the outer loop, since the effective output impedance of the error amplifier 30 is diminished. The output impedance of the error amplifier 30 is thus substantially defined by the value of the resistor $R_{SZ}$, the effect of the compensating capacitor $C_C$ forming the dominant pole position at the output of error amplifier being greatly reduced. This also eliminates the 90° phase shift associated with this pole position.

In the case in which the bandwidths of the two amplifiers are practically the same, the resulting phase shift is small since at this frequency the impedance of the compensating capacitor $C_C$ is practically the same as the impedance of the resistor $R_{SZ}$. This remaining shift in phase can be influenced by selecting the product of the value of the resistor $R_{SZ}$ and the gain $G_M$ of the transconductance amplifier 30. It needs to be taken into account, however, that the output amplifier 20, like any operational amplifier, comprises a finite input offset voltage. The product of the value of the resistor $R_{SZ}$ and the gain $G_M$ of the transconductance amplifier 30 is also a measure of the effect of the finite input offset voltage of the output amplifier 20 so that a tradeoff needs to be made between the remaining phase shift and the tolerable input offset voltage.

Figure 4:
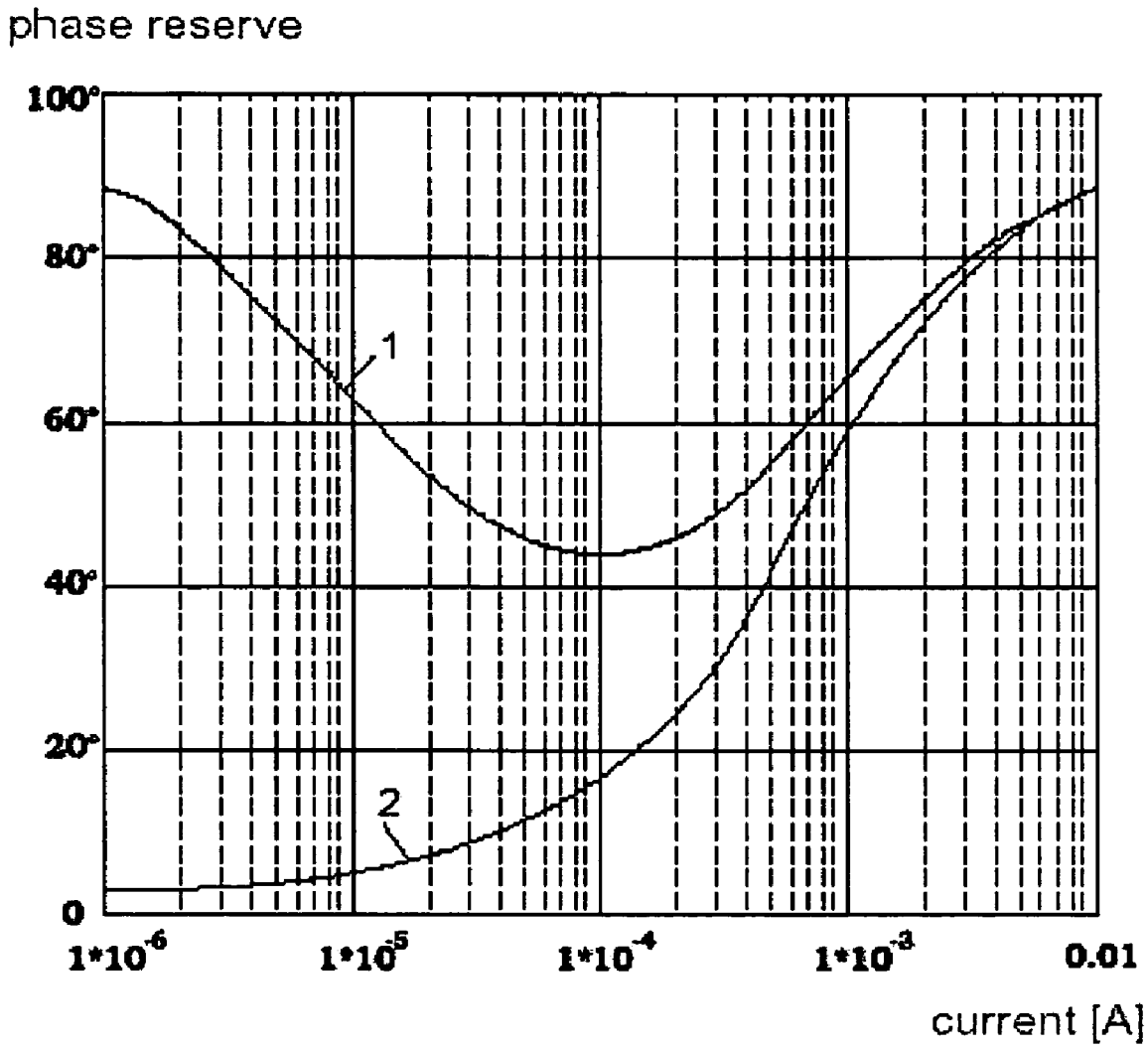
FIG. 4 is a graph plotting the phase reserve of a voltage regulator in accordance with the invention and of a voltage regulator as shown in FIG. 3 as a function of the frequency.

Referring now to FIG. 4 there is illustrated the computed plot of the phase reserve for a voltage regulator in accordance with the invention over a wide range of the load current $I_{out}$ given by the upper curve 1 as compared to the lower curve 2 illustrating the computed plot of the phase reserve for a voltage regulator as shown in FIG. 2.

For load currents $I_{out}$ exceeding roughly 1 mA the phase reserve for both circuits is practically 90° since it is substantially only the pole position of the output amplifier that produces a shift in phase.

The difference in the response of the two circuits is clearly evident with diminishing load currents $I_{out}$. Whilst the voltage regulator as shown in FIG. 2 features a phase reserve becoming continually smaller, the linear voltage regulator in accordance with the invention is still stable in the range of a few $\mu$A. With this calculation the minimum phase reserve for a voltage regulator in accordance with the invention is approximately 42°. In other words the voltage regulator thus functions in a range which is far remote from a possible unstable condition.

In the voltage regulator in accordance with the invention the gain of the error amplifier 30 is limited at low load currents with the aid of the resistor $R_{SZ}$. This is why the compensating capacitor $C_C$, as compared to a voltage regulator as shown in FIG. 2 can exhibit a substantially lower value since it is only in the case of high load currents, i.e. when the resistor $R_{SZ}$ has no effect, that the compensating capacitor $C_C$ has the effect of limiting the bandwidth. Accordingly, the compensating capacitor $C_C$ takes up only little space on the chip in being easier to integrate.

The response of the voltage regulator to an overload is likewise influenced by the resistor $R_{SZ}$. As a rule, a voltage regulator is provided with overload protection (not shown in FIG. 3) which turns off the transistor 10 when the load current $I_{out}$ exceeds a critical value. As described at the outset, in this overload condition the voltage at the drain of the transistor 10 drops to the value of the reference potential. Since the feedback signal and the reference voltage $V_{ref}$ at the input of the error amplifier 30 differ, the output of the error amplifier 30 reacts by an increase in the output current. This current is, however, limited by the resistor $R_{SZ}$ so that the voltage at the non-inverting input 24 of the output amplifier is prevented from increasing further. This prevents the voltage peaking at the output of the voltage regulator once the overload condition has been remedied.

The embodiment of the voltage regulator as shown in FIG. 3 is highly resistant to oscillating over a wide range of the load current $I_{out}$ because the voltage regulator now operates remote from any possible unstable condition due to its high phase reserve. This now makes it possible to achieve a very simple voltage regulator architecture totally integrated on a single chip. It is especially in battery—powered devices such as e.g. mobile phones or electronic organizers that this is important since these devices are often on standby with a low current consumption and activated for use only occasionally. In addition, the compensating circuit in the form of a resistor now makes for a significant improvement in the response of the voltage regulator to an overload producing too high a current at the output of the voltage regulator.

What is claimed is:

1. A voltage regulator including a transistor (10), having a main current path between the input voltage terminal ($V_{in}$) of said voltage regulator and the output of said voltage regulator, comprising:

an amplifier (20) having an output being connected to the control terminal (16) of said transistor (10) and to the one input (22) of which a voltage as a function of the output voltage ($V_{out}$) of said voltage regulator is applied, a transconductance amplifier (30) having a output being connected to the other input (24) of said amplifier (20), a first resistor ($R_{O1}$), a capacitor ($C_C$) wherein the one input (32) of said transconductance amplifier (30) is connected to a further voltage as a function of said output voltage ($V_{out}$) of said voltage regulator whilst the other input (34) of said transconductance amplifier (30) is connected to a reference voltage ($V_{ref}$) dictating said output voltage ($V_{out}$) of said voltage regulator, and a further resistor ($R_{SZ}$) is coupled between the one input (22) and the other input (24) of said amplifier (20).

wherein the value of said further resistor ($R_{SZ}$) is selected to substantially maximize the phase reserve of said voltage regulator.

2. The voltage regulator as set forth in claim 1 wherein said transistor (10) is a PNP transistor.

3. The voltage regulator as set forth in claim 1 wherein said transistor (10) is a PMOS field-effect transistor.

4. The voltage regulator as set forth in claim 3 wherein the source/drain circuit of said PMOS field-effect transistor (10) is selected sufficiently wide that said voltage regulator can operate as a low-dropout voltage regulator.

5. A voltage regulator including a transistor (10), having a main current path between the input voltage terminal ($V_{in}$) of said voltage regulator and the output of said voltage regulator, comprising:

an amplifier (20) having an output being connected to the control terminal (16) of said transistor (10) and to the one input (22) of which a voltage as a function of the output voltage ($V_{out}$) of said voltage regulator is applied, a transconductance amplifier (30) having a output being connected to the other input (24) of said amplifier (20), a first resistor ($R_{O1}$), a capacitor ($C_C$) wherein the one input (32) of said transconductance amplifier (30) is connected to a further voltage as a function of said output voltage ($V_{out}$) of said voltage regulator whilst the other input (34) of said transconductance amplifier (30) is connected to a reference voltage ($V_{ref}$) dictating said output voltage ($V_{out}$) of said voltage regulator, and a further resistor ($R_{SZ}$) is coupled between the one input (22) and the other input (24) of said amplifier (20), wherein the value of said capacitor ($C_C$) is selected so that as of a critical value of a current flowing at the output of said voltage regulator the cutoff frequency of said transconductance amplifier (30) is lower than that of said amplifier (20).

6. The voltage regulator as in claim 5 wherein said voltage regulator is configured as a monolithic integrated semiconductor circuit.

7. A voltage regulator including a transistor (10), having a main current path between the input voltage terminal ($V_{in}$) of said voltage regulator and the output of said voltage regulator, comprising:

an amplifier (20) having an output being connected to the control terminal (16) of said transistor (10) and to the one input (22) of which a voltage as a function of the output voltage ($V_{out}$) of said voltage regulator is applied, a transconductance amplifier (30) having a output being connected to the other input (24) of said amplifier (20), a first resistor ($R_{O1}$), a capacitor ($C_C$) wherein the one input (32) of said transconductance amplifier (30) is connected to a further voltage as a function of said output voltage ($V_{out}$) of said voltage regulator whilst the other input (34) of said transconductance amplifier (30) is connected to a reference voltage ($V_{ref}$) dictating said output voltage ($V_{out}$) of said voltage regulator, and a further resistor ($R_{SZ}$) is coupled between the one input (22) and the other input (24) of said amplifier (20), wherein the value of said first resistor ($R_{O1}$) is adapted to the transconductance of said error amplifier (30).

* * * * *